US008847501B1

(12) United States Patent
Chu et al.

(10) Patent No.: US 8,847,501 B1
(45) Date of Patent: Sep. 30, 2014

(54) APPARATUS FOR DRIVING LEDS USING HIGH VOLTAGE

(71) Applicant: VastView Technology Inc., Hsinchu County (TW)

(72) Inventors: Hung-Chi Chu, Hsinchu County (TW); Chang-Cheng Lin, Hsinchu County (TW); YuhRen Shen, Hsinchu County (TW)

(73) Assignee: VastView Technology Inc., Hsinchu County (TW)

( * ) Notice: Subject to any disclaimer, the term of this patent is extended or adjusted under 35 U.S.C. 154(b) by 16 days.

(21) Appl. No.: 13/868,304

(22) Filed: Apr. 23, 2013

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01)
USPC ..... 315/193; 315/122; 315/192; 315/291

(58) Field of Classification Search
USPC ..... 315/122, 192, 193, 291, 308, 323
See application file for complete search history.

(56) References Cited

U.S. PATENT DOCUMENTS 6,989,807 B2 1/2006 Chiang
7,081,722 B1 * 7/2006 Huynh et al. ..... 315/323
7,439,944 B2 * 10/2008 Huynh et al. ..... 345/82
8,324,840 B2 * 12/2012 Shteynberg et al. ..... 315/308
8,410,717 B2 * 4/2013 Shteynberg et al. ..... 315/291
8,598,796 B2 * 12/2013 Jeong ..... 315/192
2010/0308739 A1 * 12/2010 Shteynberg et al. ..... 315/193
2011/0084618 A1 4/2011 Kang et al.
2011/0089844 A1 4/2011 Grajcar
2012/0038285 A1 2/2012 Leung et al.
2012/0056559 A1 3/2012 Fu et al.
2012/0081009 A1 * 4/2012 Shteynberg et al. ..... 315/122
2012/0217887 A1 8/2012 Kang et al.
2012/0262075 A1 10/2012 Lynch et al.
2012/0280622 A1 11/2012 Jeong et al.
2012/0313541 A1 12/2012 Egawa et al.

* cited by examiner

*Primary Examiner* — Vibol Tan
(74) *Attorney, Agent, or Firm* — Lin & Associates IP, Inc.

(57) ABSTRACT

An apparatus for driving LEDs using high voltage includes a plurality of LEDs divided into a plurality of LED segments connected in series and a plurality of three-terminal voltage controlled current limiting devices. Each of the current limiting devices is associated with one of the LED segments and has a first terminal connected to a negative end of the associated LED segment, a second terminal applied with a bias voltage and a third terminal connected to a common node. A current source is connected between the common node and ground. A power-loss reduction circuit having a plurality of LEDs controlled by an LED controlling circuit may further be inserted between the common node and the current source to reduce the power loss in the current source because of the high voltage at the common node.

23 Claims, 17 Drawing Sheets

| Number of Segments | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|
| Total number of LEDs | 42 | 42 | 42 | 42 | 41 | 41 | 40 | 40 | 40 | 39 | 39 | 39 | 38 | 38 | 37 | 37 | 37 | 36 | 36 |
| Number of LEDs in each segment | 23 | 14 | 11 | 9 | 8 | 7 | 6 | 5 | 5 | 4 | 4 | 3 | 3 | 3 | 3 | 3 | 3 | 3 | 3 |
| | 19 | 14 | 11 | 9 | 8 | 7 | 5 | 5 | 4 | 4 | 4 | 3 | 3 | 3 | 3 | 3 | 3 | 3 | 2 |
| | | 14 | 10 | 8 | 7 | 6 | 5 | 5 | 4 | 4 | 4 | 3 | 3 | 3 | 3 | 3 | 3 | 2 | 2 |
| | | | 10 | 8 | 7 | 6 | 5 | 5 | 4 | 4 | 3 | 3 | 3 | 3 | 3 | 3 | 3 | 2 | 2 |
| | | | | 8 | 6 | 6 | 5 | 5 | 4 | 4 | 3 | 3 | 3 | 3 | 3 | 3 | 2 | 2 | 2 |
| | | | | | 5 | 5 | 5 | 4 | 4 | 4 | 3 | 3 | 3 | 3 | 3 | 2 | 2 | 2 | 2 |
| | | | | | | 4 | 5 | 4 | 4 | 3 | 3 | 3 | 3 | 3 | 2 | 2 | 2 | 2 | 2 |
| | | | | | | | 4 | 4 | 4 | 3 | 3 | 3 | 3 | 3 | 2 | 2 | 2 | 2 | 2 |
| | | | | | | | | 3 | 4 | 3 | 3 | 3 | 3 | 2 | 2 | 2 | 2 | 2 | 2 |
| | | | | | | | | | 3 | 3 | 3 | 3 | 3 | 2 | 2 | 2 | 2 | 2 | 2 |
| | | | | | | | | | | 3 | 3 | 3 | 2 | 2 | 2 | 2 | 2 | 2 | 2 |
| | | | | | | | | | | | 3 | 3 | 2 | 2 | 2 | 2 | 2 | 2 | 2 |
| | | | | | | | | | | | | 3 | 2 | 2 | 2 | 2 | 2 | 2 | 2 |
| | | | | | | | | | | | | | 2 | 2 | 2 | 2 | 2 | 2 | 2 |
| | | | | | | | | | | | | | | 2 | 2 | 2 | 2 | 2 | 2 |
| | | | | | | | | | | | | | | | 1 | 1 | 1 | 1 | 1 |
| | | | | | | | | | | | | | | | | 1 | 1 | 1 | 1 |
| | | | | | | | | | | | | | | | | | 1 | 1 | 1 |
| | | | | | | | | | | | | | | | | | | 1 | 1 |
| | | | | | | | | | | | | | | | | | | | 1 |

FIG. 6

APPARATUS FOR DRIVING LEDS USING HIGH VOLTAGE

BACKGROUND OF THE INVENTION

1. Field of the Invention

The present invention relates generally to light emitting diode (LED) based lighting apparatus, and more particularly to an apparatus for driving an LED based lighting apparatus using high input voltage.

2. Description of Related Arts

LEDs are semiconductor-based light sources often employed in low-power instrumentation and appliance applications for indication purposes in the past. The application of LEDs in various lighting units has also become more and more popular. For example, high brightness LEDs have been widely used for traffic lights, vehicle indicating lights, and braking lights. In recent years, high voltage LED-based lighting apparatus have been developed to replace the conventional incandescent and fluorescent lamps.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting string and a number of LED-based lighting strings may further be connected in series to form a lighting apparatus. The operating voltage required by each lighting string typically is related to the forward voltage of the LEDs in each lighting string, how many LEDs are employed for each of the lighting string and how they are interconnected, and how the respective lighting strings are organized to receive power from a power source.

Accordingly, in many applications, some type of voltage conversion device is required in order to provide a generally lower operating voltage to one or more LED-based lighting strings from more commonly available higher power supply voltages. The need of a voltage conversion device reduces the efficiency, costs more and also makes it difficult to miniaturize an LED-based lighting device.

In order to increase the efficiency and miniaturize the LED-based lighting apparatus, many techniques have been developed for the apparatus to use operating voltages such as 120V AC or 240V AC without requiring a voltage conversion device. In general, the LEDs in the apparatus are divided into a number of LED segments that can be selectively turned on or off by associated switches or current sources, and a controller is used to control the switches or current sources as the operating AC voltage increases or decreases.

In the prior arts, most of the high voltage LED-based lighting apparatus rely on the detection of the voltage level of the input AC voltage or the current flowing through the apparatus so as to control the switches or current sources to turn on or off selected LED segments. For example, U.S. Pat. Nos. 6,989,807 and 8,324,840 and U.S. Pat. Publication No. 2011/0089844 use a global controller that detects the input voltage level for controlling the current sources or switches connected to the LEDs. U.S. Pat. Publication No. 2012/0056559 and 2012/0217887 use a global controller to control current clamping units or switches according to local current sensing data.

As more and more LED-based lighting apparatus are used in high brightness lighting equipment with high input voltage, there is a strong need to design methods and apparatus that can drive and connect the LED-based lighting strings intelligently and efficiently to increase the utilization of the LEDs, reduce power loss and provide stable and high brightness by using the readily available AC source from a wall power unit.

SUMMARY OF THE INVENTION

The present invention has been made to provide an apparatus that can efficiently drive a LED string with low power loss using high input voltage. In accordance with the present invention, the apparatus comprises a plurality of LEDs divided into a plurality of LED segments connected in series and a plurality of three-terminal voltage controlled current limiting devices associated with the LED segments.

Each LED segment has a positive end and a negative end. Each of the current limiting devices in the present invention has a first terminal connected to the negative end of the associated LED segment, a second terminal applied with a bias voltage and a third terminal connected to a common node in the apparatus. An input voltage source is connected to the leading LED segment in the apparatus to provide power.

According to a first preferred embodiment of the present invention, a current source is connected between the common node and ground. Preferably, all the three-terminal voltage controlled current limiting devices have the same characteristics and the second terminals of the current limiting devices are provided with bias voltages that are gradually increasing in an order from the leading LED segment to the trailing LED segment.

As the input voltage increases, the voltage level at the common node also increases. The apparatus in the first preferred embodiment has either at most two current limiting devices partially turned on or only one current limiting device fully turned on because of the gradually increasing bias voltages. As a result, LED segments are sequentially turned on one by one from the leading LED segment to the trailing LED segment as the input voltage increases and sequentially turned off one by one reversely as the input voltage decreases.

If not all of the three-terminal voltage controlled current limiting devices have the same characteristics in the apparatus, the bias voltages required for the current limiting devices may not be gradually increasing in the order from the leading LED segment to the railing LED segment. As a result, there may be multiple current limiting devices partially turned on at the same time.

According to a second preferred embodiment of the present invention, a power-loss reduction circuit is further inserted between the common node and the current source so as to reduce the power loss in the current source because of the high voltage at the common node. The power-loss reduction circuit has a plurality of LEDs divided into a plurality of LED segments controlled by an LED controlling circuit. The LED segments in the power-loss reduction circuit are connected in series between the common node and the current source.

In a first implementation of the second preferred embodiment, the LED controlling circuit has a plurality of switches associated with the plurality of LED segments. Each switch connects the positive end of the associated LED segment in the power-loss reduction circuit to the current source. The plurality of switches is controlled by a controller in the LED controlling circuit to selectively turn on or off the LED segments to convert the power loss in the first preferred embodiment into LED power for the LED segments in the power-loss reduction circuit.

In a second implementation of the second preferred embodiment, the LED controlling circuit also has a plurality of switches associated with the plurality of LED segments. Each switch is connected in parallel with the associated LED segment in the power-loss reduction circuit. As a result, each LED segment in the power-loss reduction circuit can be individually turned on or off in the second implementation.

In a third implementation of the second preferred embodiment, the LED controlling circuit is formed by a plurality of three-terminal voltage controlled current limiting devices associated with the plurality of LED segments in the power-loss reduction circuit. The circuit structure in the third implementation of the second preferred embodiment is similar to two circuits of the first preferred embodiment cascaded together.

BRIEF DESCRIPTION OF THE DRAWINGS

The present invention will be apparent to those skilled in the art by reading the following detailed description of preferred embodiments thereof, with reference to the attached drawings, in which:

FIG. 6 shows the number of segments, the total number of LEDs and the number of LEDs in each segment for a few design examples according to the first preferred embodiment;

DETAILED DESCRIPTION OF THE PREFERRED EMBODIMENT

Figure 1:
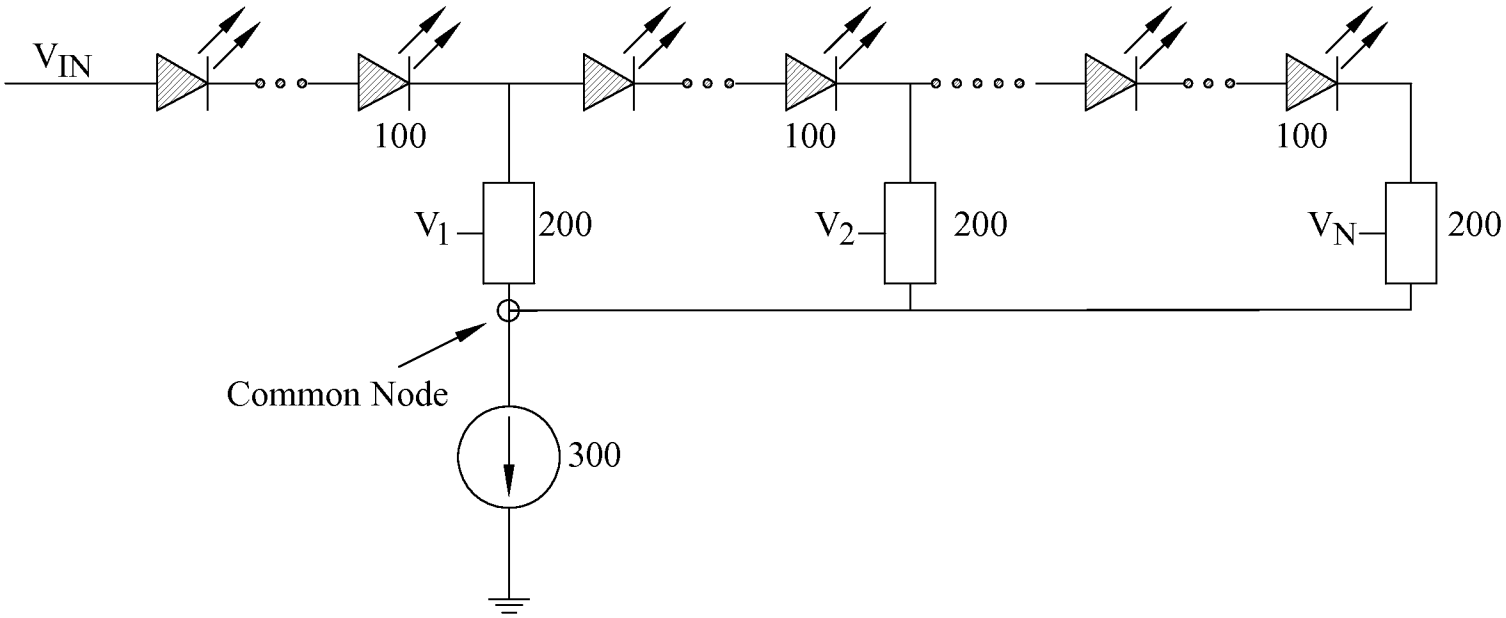
FIG. 1 shows a block diagram of an apparatus for driving LEDs using high voltage according to a first preferred embodiment of the present invention.

The accompanying drawings are included to provide a further understanding of the invention, and are incorporated in and constitute a part of this specification. The drawing illustrates embodiments of the invention and, together with the description, serves to explain the principles of the invention.

FIG. 1 shows a block diagram of an apparatus for driving LEDs using high voltage according to a first preferred embodiment of the present invention. In the embodiment, the apparatus comprises a plurality of LEDs connected in series. The plurality of LEDs is divided into a plurality of LED segments 100. Each LED segment 100 has a positive end and a negative end connected respectively to the negative end of its preceding LED segment and the positive end of its following LED segment.

As can be seen in FIG. 1, the negative end of each LED segment is also connected to a first terminal of a three-terminal voltage controlled current limiting device 200. The second terminal of the three-terminal voltage controlled limiting device is connected to a bias voltage and the third terminal is connected to a common node. A current source 300 is connected between the common node and ground.

Figure 2:
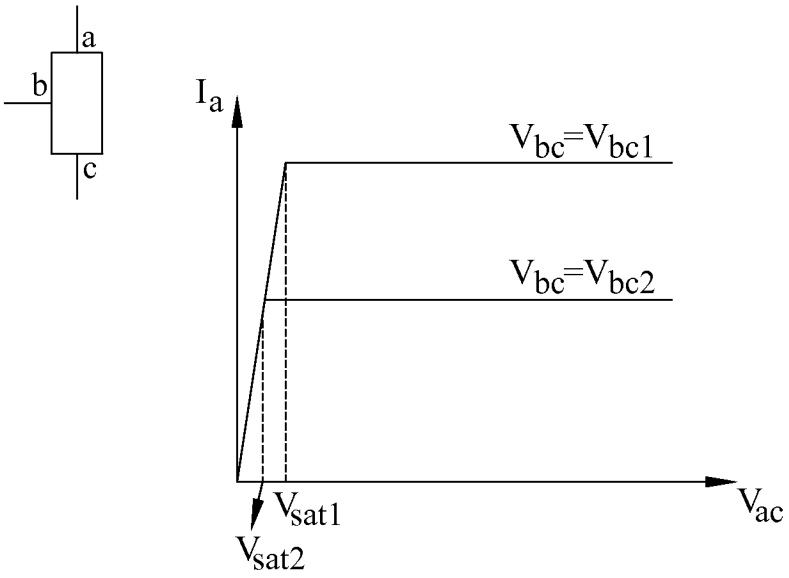
FIG. 2 shows the I-V characteristics of the three-terminal voltage controlled current limiting device according to the present invention.

FIG. 2 shows the I-V characteristics of the three-terminal voltage controlled current limiting device according to the present invention. When the voltage $V_{bc}$ across the second and third terminals (terminals b and c) is less than or equal to the threshold voltage $V_{th}$ of the three-terminal voltage controlled current limiting device, the current limiting device is cut off and the current $I_a$ flowing through the current limiting device is zero.

When the voltage $V_{bc}$ is greater than the threshold voltage $V_{th}$, and the voltage $V_{ac}$ across the first and third terminals (terminals a and c) is less than a saturation voltage $V_{sat}$ of the three-terminal voltage controlled current limiting device, the current limiting device behaves like a resistor. In other words, $I_a$ is linearly proportional to $V_{ac}$.

As can be seen from FIG. 2, when the voltage $V_{bc}$ is greater than the threshold voltage $V_{th}$, and the voltage $V_{ac}$ across terminals a and c is greater than the saturation voltage $V_{sat}$, three-terminal voltage controlled current limiting device becomes a constant current source and $I_a$ is a function of $V_{bc}$, i.e. $I_a=f(V_{bc})$. It can also be noted that the saturation voltage $V_{sat}$ is proportional to $V_{bc}$.

From FIG. 2, it can be understood that by applying different bias voltages $V_1, V_2, \ldots$, and $V_N$ to the second terminals of the three-terminal voltage controlled current limiting devices in the apparatus shown in FIG. 1, each current limiting device in the apparatus may be cut off or turned on at different time as the input voltage $V_{IN}$ of the apparatus varies with time.

In the present invention, the characteristics of the three-terminal voltage controlled current limiting devices are such that for each current limiting device to have a given current I, the respective $V_{bc}$ and $V_{th}$ for the current limiting devices can be described as $V_{bc1}=V_{th1}+\Delta V_1$, $V_{bc2}=V_{th2}+\Delta V_2$, $V_{bc3}=V_{th3}+\Delta V_3$, . . . , and $V_{bcN}=V_{thN}+\Delta V_N$, where N is the total number of the three-terminal voltage controlled current limiting devices in the apparatus.

According to the first preferred embodiment of the present invention shown in FIG. 1, the preferred bias voltages $V_1$, $V_2$, . . . , and $V_N$ satisfy the following conditions:

$$V_2 \geq V_1+\Delta V_2+(V_{th2}-V_{th1}),$$

$$V_3 \geq V_2+\Delta V_3+(V_{th3}-V_{th2}),$$

$$\ldots$$

$$V_N \geq V_{N-1}+\Delta V_N+(V_{thN}-V_{th(N-1)}).$$

With the above conditions, when the input voltage $V_{IN}$ increases to the level that the first current limiting device begins to turn on until its current reaches a maximum, current level, the second and following current limiting devices are still cut off because the voltage $V_{ac}$ across their respective first and third terminals are zero due to the required forward voltages of the LEDs in the respective segment.

When the input voltage $V_{IN}$ continues to increase until the $V_{ac}$ of the second current limiting device is greater than zero, the second current limiting device is turned on to have a current flowing through the LEDs in the second segment. The total current flowing through the two current limiting devices partially turned on is $I=I_1+I_2$, where $I_1$ and $I_2$ are the current flowing through the first and second current limiting devices respectively when both devices are turned on.

As the input voltage $V_{IN}$ continues to increase, the current $I_1$ flowing through the first current limiting device decreases while the current $I_2$ flowing through the second current limiting device increases. Because of the I-V characteristics shown in FIG. 2, the current $I_2$ increases until it reaches the maximum current level I and the voltage level at the common node increases to $(V_2-V_{th2}-\Delta V_2) \geq (V_1-V_{th1})$ which cut off the first current limiting device with $I_1=0$.

Based on the above analysis, the current limiting devices can be turned on one after the other in an order from the leading LED segment to the tailing LED segment as the input voltage $V_{IN}$ increases. Similarly, as the input voltage $V_{IN}$ decreases, the voltage level at the common node also decreases and the current limiting devices are turned on one after the other in a reverse order. When the current limiting device K is fully turned on, the other current limiting devices 1, 2, . . . , K−1, K+1, . . . , and N are all turned off. At any time, either at most two current limiting devices are partially turned on or one current limiting device is fully turned on.

In the case that all the three-terminal voltage controlled current limiting devices in the apparatus have the same characteristics, i.e. $V_{th1}=V_{th2}=V_{th3}= \ldots =V_{thN}$, and $\Delta V_1=\Delta V_2=\Delta V_3= \ldots =\Delta V_N=\Delta V$, the bias voltages in the first preferred embodiment of the present invention satisfy the condition:

$$V_2 \geq V_1+\Delta V_2+(V_{th2}-V_{th1})=V_1+\Delta V,$$

$$V_3 \geq V_2+\Delta V_3+(V_{th3}-V_{th2})=V_2+\Delta V,$$

$$\ldots$$

$$V_N \geq V_{N-1}+\Delta V_N+(V_{thN}-V_{th(N-1)})-V_{N-1}+\Delta V.$$

In other words, the apparatus can be applied with bias voltages $V_1<V_2< \ldots <V_N$ so as to either fully turn on only one current limiting device or have at most two current limiting devices partially turned on as the input voltage $V_{IN}$ increases and decreases.

If all the three-terminal voltage controlled current limiting devices do not have the same characteristics, the bias voltages in the first preferred embodiment of the invention may not satisfy the condition $V_1<V_2< \ldots <V_N$. Under this circumstance, the current limiting devices can not be sequentially turned on or off. The LED lighting apparatus is still functional but the current limiting devices in multiple segments may be partially turned on at the same time.

It is important to note that the bias voltages $V_1$, $V_2$, . . . , and $V_N$ applied to the second terminals of the three-terminal voltage controlled current limiting devices are respective constant voltages independent of variation of the input voltage $V_{IN}$. The switching of the LED segments in the present invention is continuous and the control is based on the increase or decrease of the voltage level at the common node instead of sensing the voltage level of the input voltage or the current level flowing through the current limiting device. Regardless whether the three-terminal voltage controlled current limiting devices have the same or different characteristics, the current limiting devices in multiple segments may be partially turned on at the same if the bias voltages $V_1$, $V_2$, . . . , and $V_N$ are not set to meet the conditions described above.

The three-terminal voltage controlled current limiting device can be implemented with various semiconductor devices. A few preferred examples are N-channel Metal Oxide Semiconductor Field Effect Transistor (MOSFET), NPN Bipolar Junction Transistor (BJT), and N-channel Insulated Gate Bipolar Transistor (IGBT). In addition, the three-terminal voltage controlled current limiting device in the last segment is optional, and the number of LEDs in each segment may be different.

Figure 3:
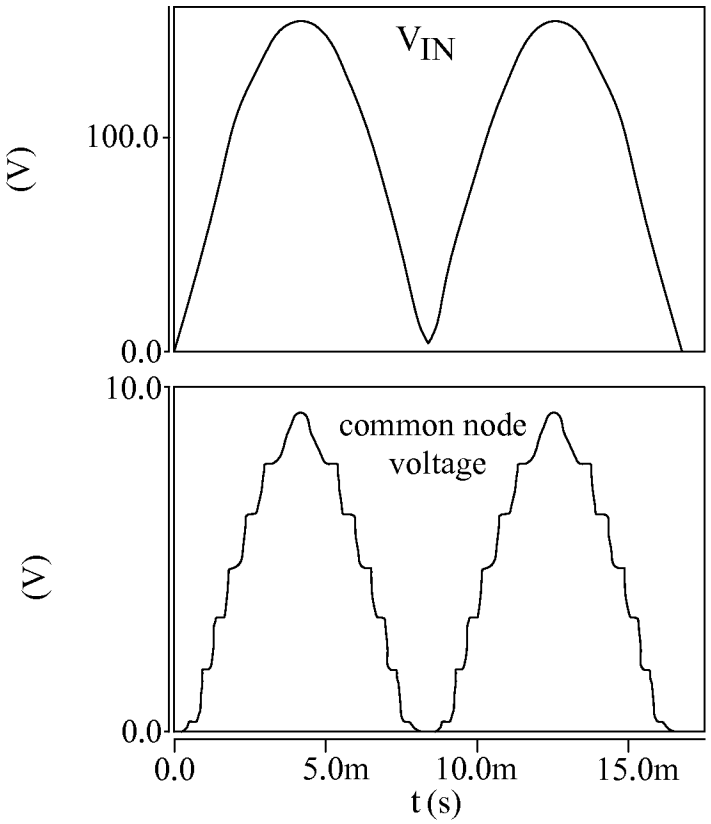
FIG. 3 shows the simulated wave form of the input voltage and the corresponding voltage level at the common node according to the first preferred embodiment.

FIG. 3 shows the simulated wave form of the input voltage $V_{IN}$ and the corresponding voltage level at the common node according to the first preferred embodiment shown in FIG. 1. It is assumed that there are 7 segments in the LED-based lighting apparatus and the input voltage is rectified AC voltage.

Figure 4:
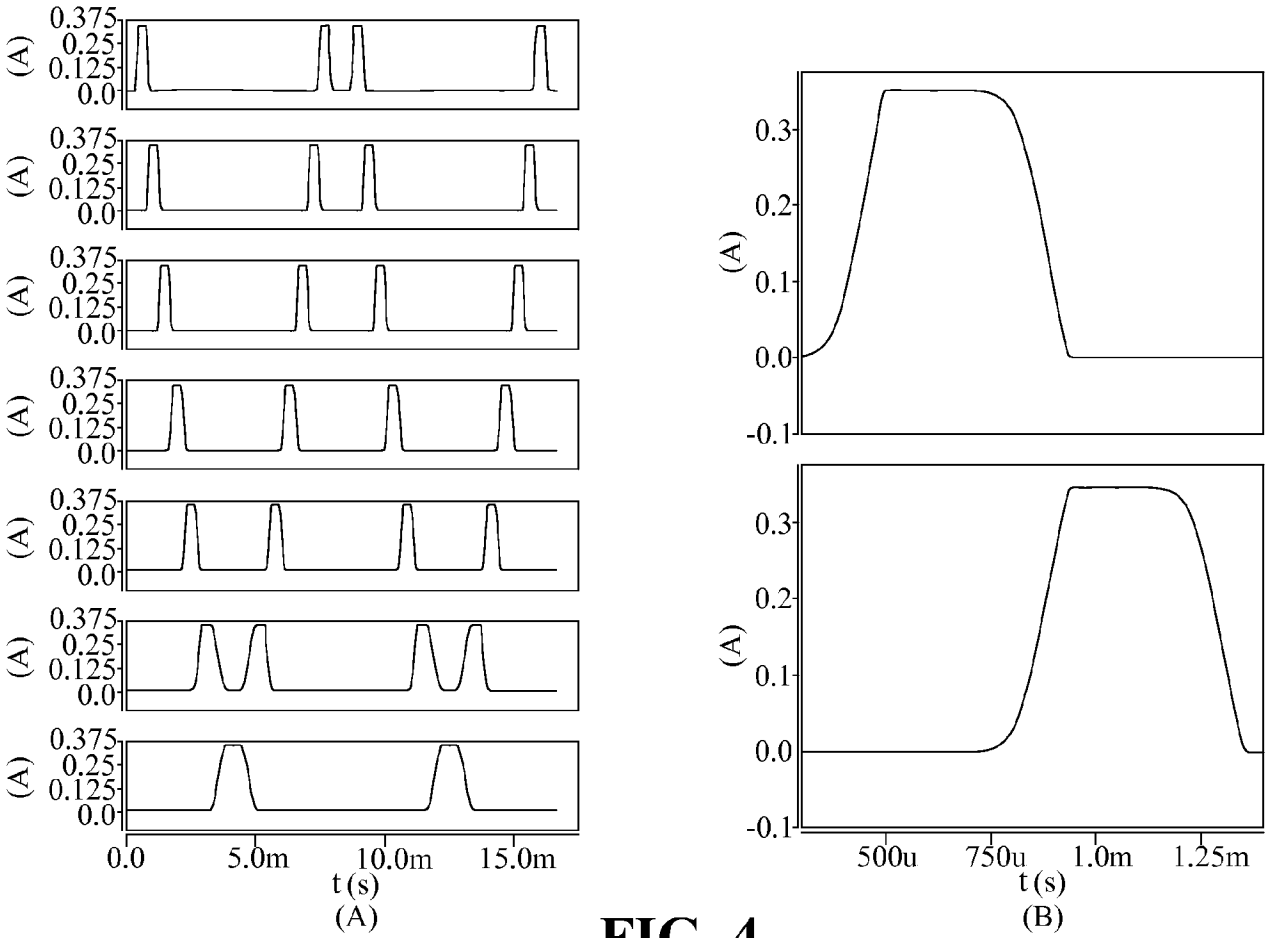
FIG. 4A shows the current flowing through each current limiting device as the input voltage level changes according to the input voltage shown in FIG. 3.
FIG. 4B shows the magnified views of the top two charts shown in FIG. 4A.
Figure 5:
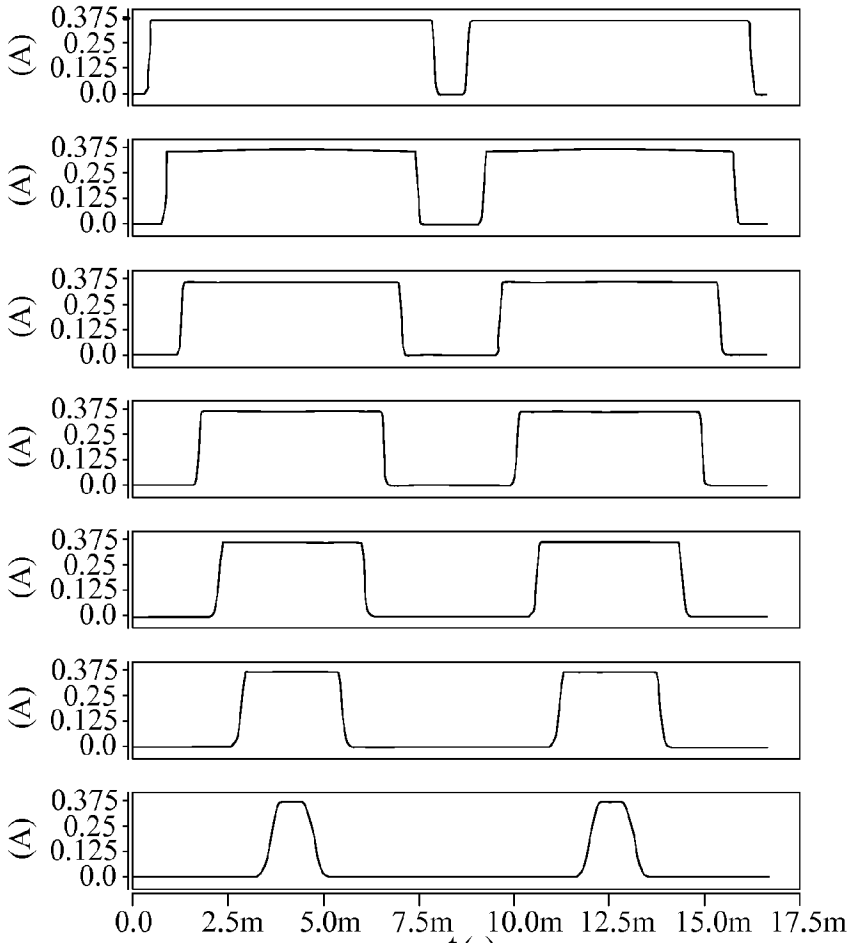
FIG. 5 shows the current flowing through the LEDs of the apparatus as the input voltage varies.

From top to bottom, FIG. 4A shows the currents flowing through the seven current limiting devices respectively as the input voltage level changes according to the input voltage shown in FIG. 3. FIG. 4B shows the magnified views of the top two charts shown in FIG. 4A. FIG. 5 shows the current flowing through the LEDs of the apparatus as the input voltage varies.

According to the present invention, the voltage level at the common node has to increase as the input voltage increases in order for the current limiting devices to be switched on and off sequentially. For a given input voltage, the total number of LEDs has to gradually decrease if the number of segments in the apparatus increases so that there is enough LED current when the last current limiting device is the only one turned on.

Figure 7:
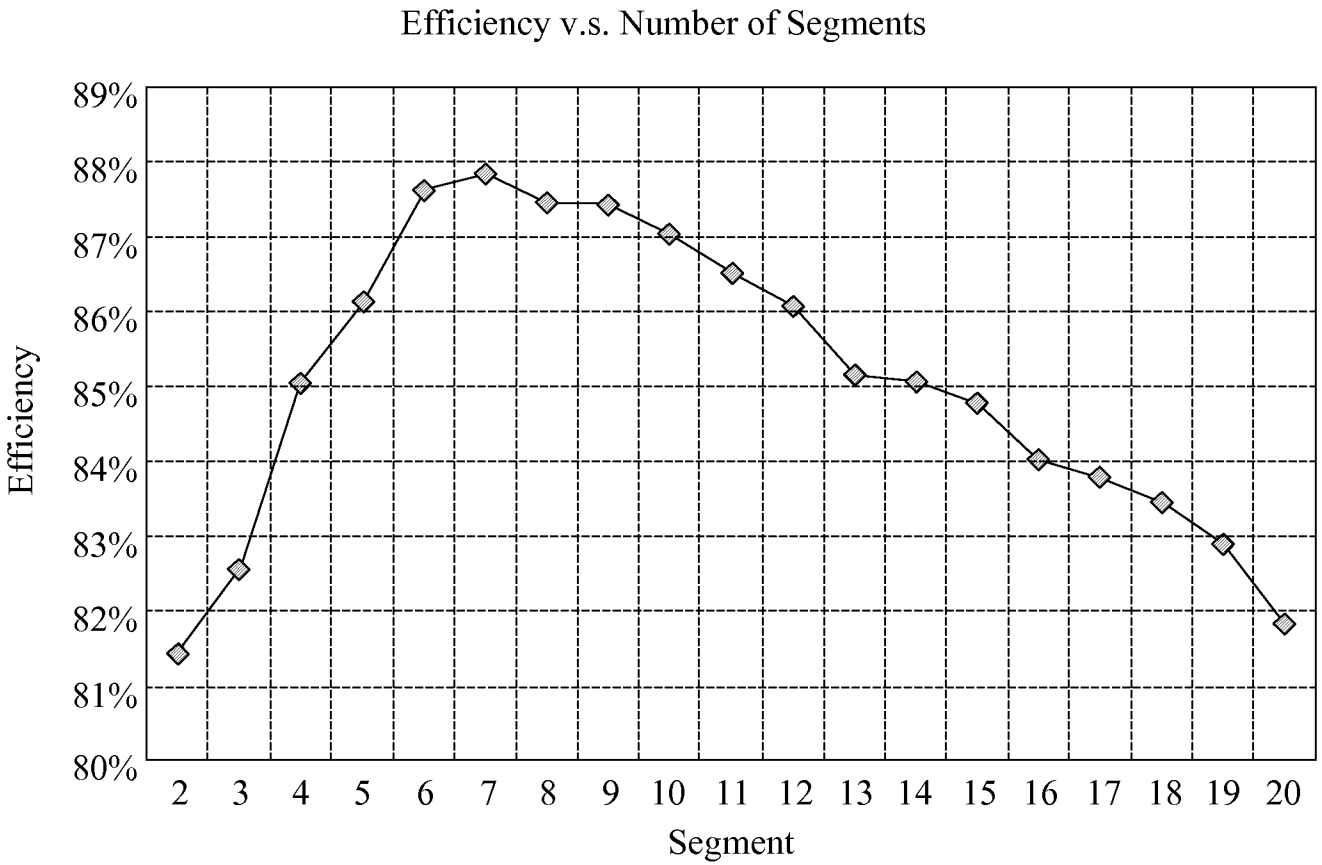
FIG. 7 shows the efficiency of the first preferred embodiment as a function of the total number of segments in the apparatus.
Figure 8:
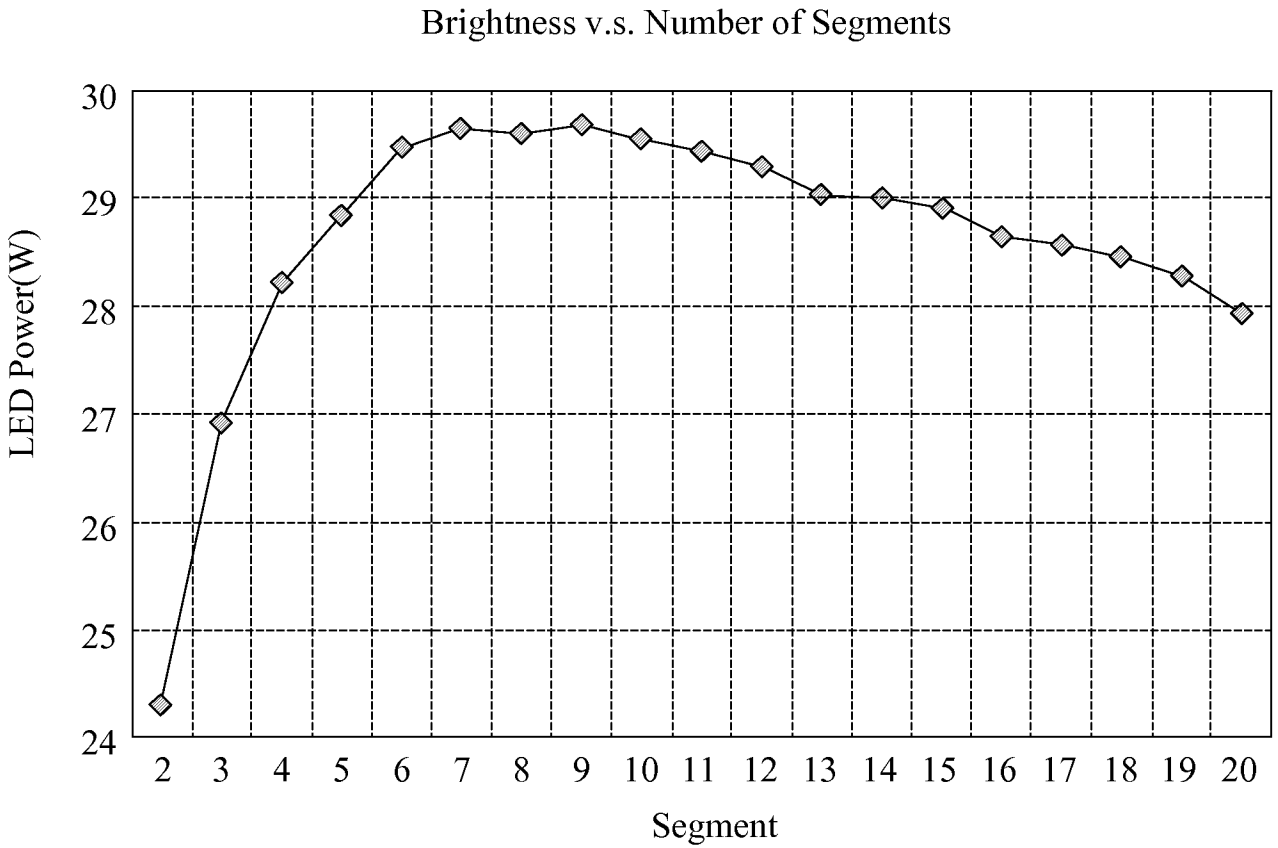
FIG. 8 shows the brightness (LED power) of the first preferred embodiment as a function of the total number of segments in the apparatus.

FIG. 6 shows the number of segments, the total number of LEDs and the number of LEDs in each segment for a few design examples according to the first preferred embodiment assuming that the input voltage is rectified 110V AC of 60 Hz and the current source provides a 350 mA current. FIGS. 7 and 8 show the efficiency and brightness (LED power) of the first preferred embodiment respectively as a function of the total number of segments in the apparatus.

When the number of segments is less than 7, the power loss is mainly from the three-terminal voltage controlled current devices. When the number of segments is greater than 7, the power loss is mainly from the current source. As the voltage level at the common node increases due to the increasing number of segments, the power loss from the current source also increases. It can be seen that the optimal number of segments is approximately from 6 to 9.

Figure 9:
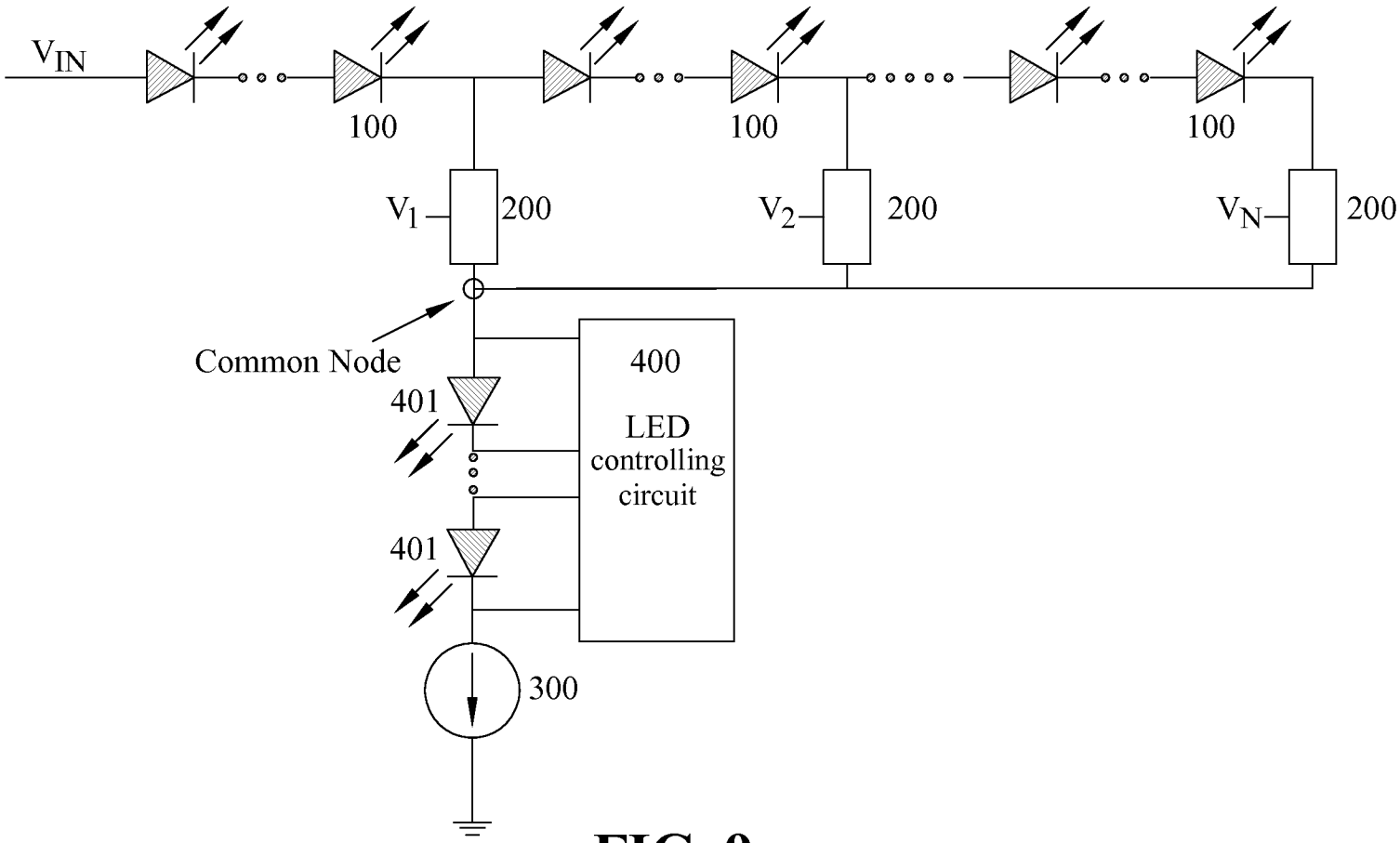
FIG. 9 shows the block diagram of an apparatus according to the second preferred embodiment in which the power loss in the first preferred embodiment is converted to LED power.

As described above, the voltage level at the common node increases as the input voltage $V_{IN}$ in the first preferred embodiment increases. The higher voltage level at the common node results in unnecessary power loss. Therefore, the present invention further provides a second preferred embodiment for reducing the power loss. FIG. 9 shows the block diagram of an apparatus according to the second preferred embodiment in which the power loss in the first preferred embodiment is converted to LED power.

As can be seen in FIG. 9, a power-loss reduction circuit which includes a plurality of LEDs and an associated LED controlling circuit 400 is inserted between the common node and the current source 300. The plurality of LEDs is divided into a plurality of LED segments 401. For simplicity, only one LED is shown in each LED segment 401. According to the second preferred embodiment, the number of turned-on LED segments 401 is controlled by the LED controlling circuit 400 to increase as the voltage level at the common node increases. As a result, the power loss from the current source is reduced.

Figure 10A:
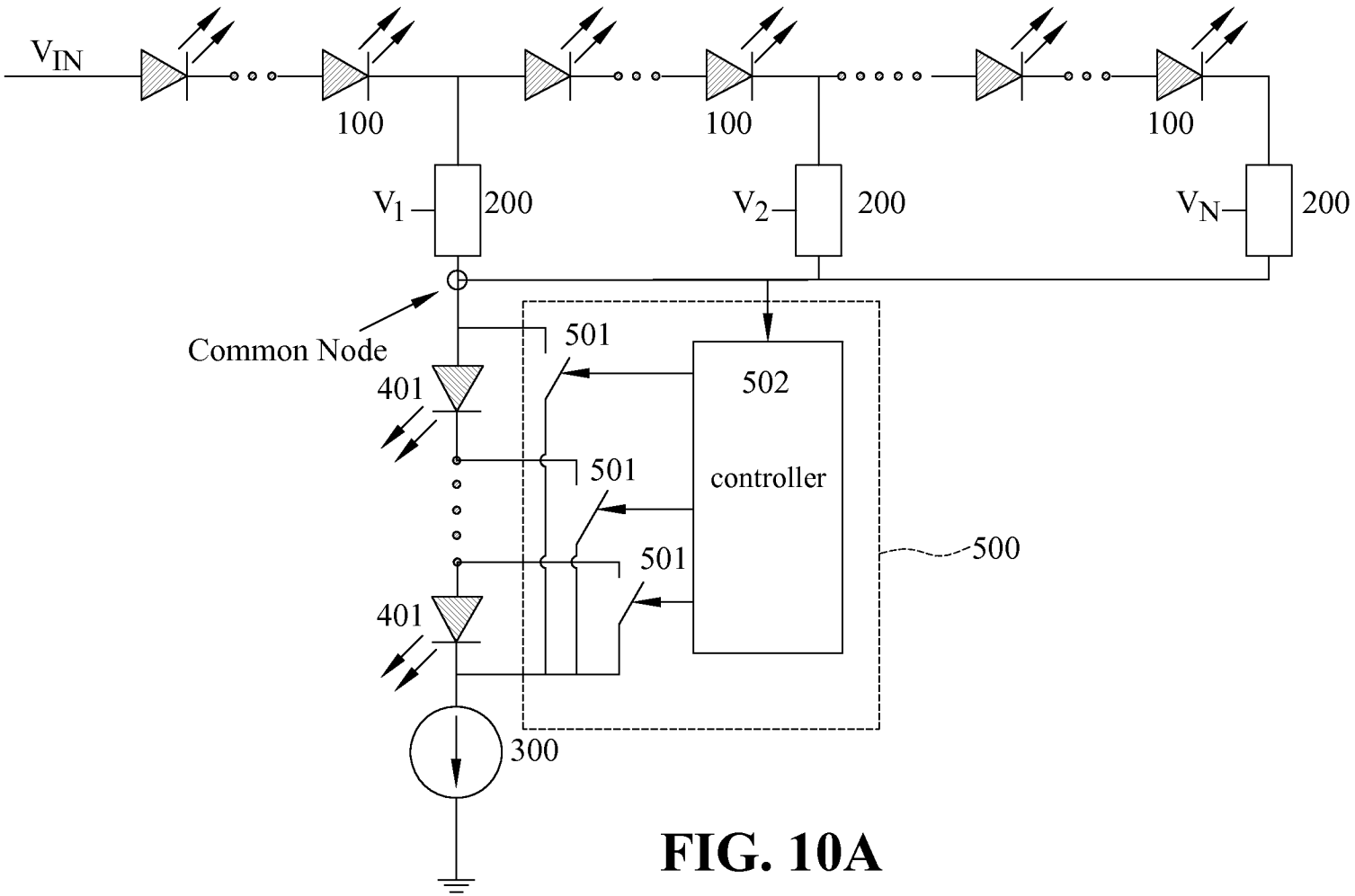
FIG. 10A shows a first example of a first implementation of the second preferred embodiment according to the present invention.
Figure 10B:
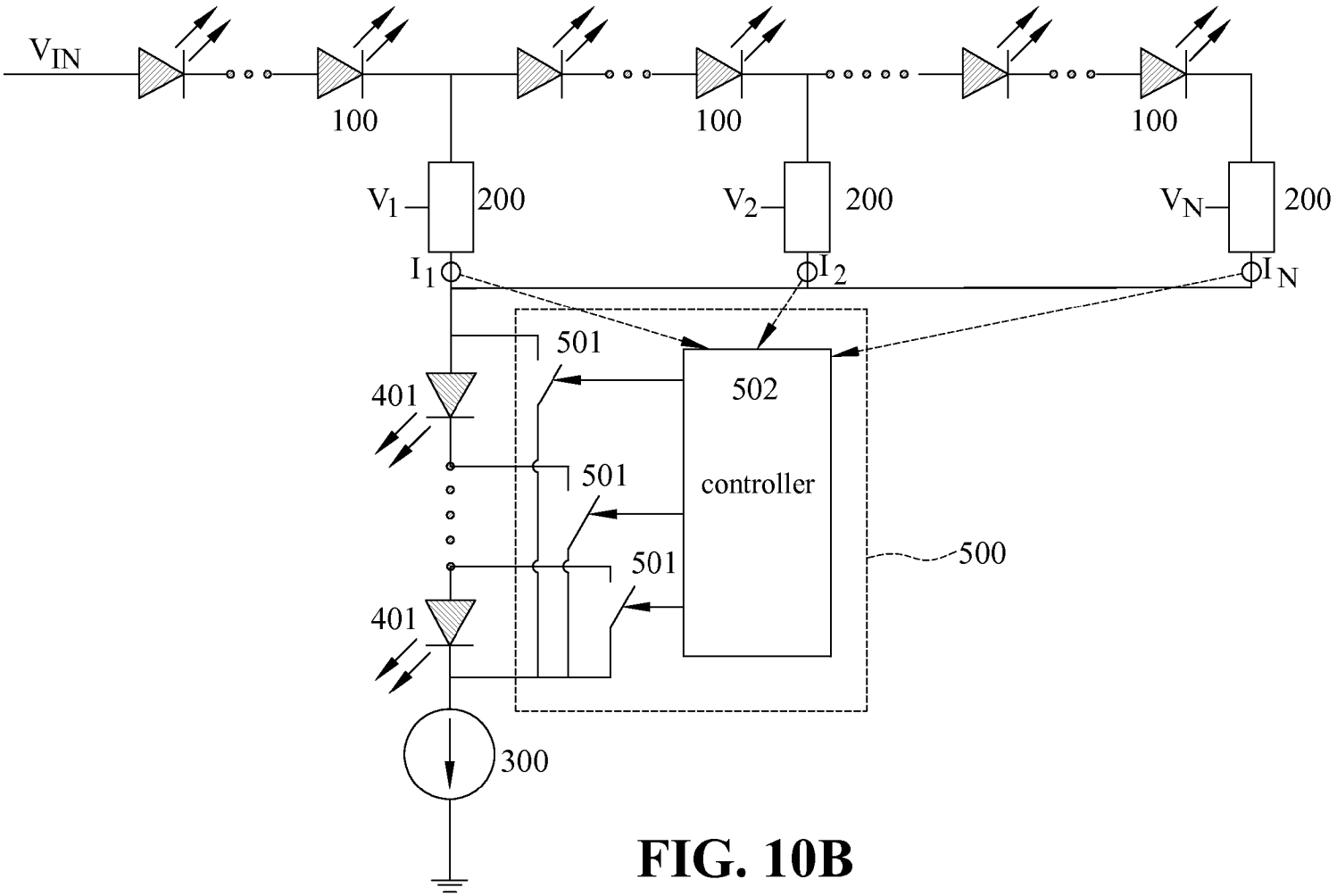
FIG. 10B shows a second example of the first implementation of the second preferred embodiment according to the present invention.

FIGS. 10A and 10B shows two examples of a first implementation of the second preferred embodiment according to the present invention. As can be seen from the first example shown in FIG. 10A, the controlling circuit 500 comprises a plurality of switches 501 associated with the plurality of LED segments 401 and controlled by a controller 502. Each switch 501 connects the positive end of the associated LED segment 401 to the current source 300. The plurality of switches 501 are controlled by the controller 502 to determine how the LED segments 401 are by-passed according to the voltage level at the common node.

In the second example shown in FIG. 10B, the circuit is essentially the same as the circuit of FIG. 10A. However, the plurality of switches 501 are controlled by the controller 502 to determine how the LED segments 401 are by-passed according to the respective current $I_1, I_2, \ldots$, and $I_N$ flowing through the three-terminal voltage controlled current limiting devices 200 instead of the voltage level at the common node.

Figure 11A:
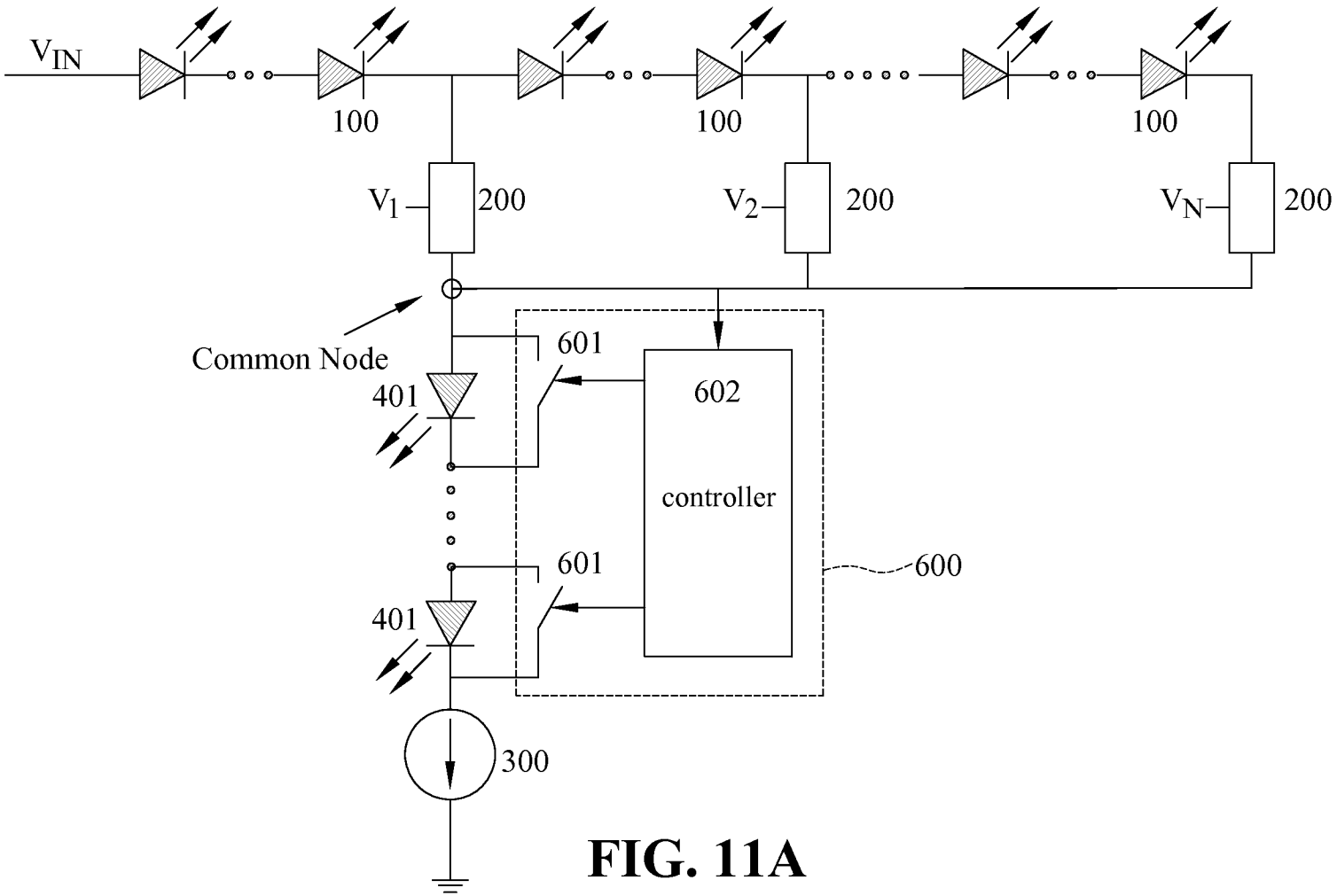
FIG. 11A shows a first example of a second implementation of the second preferred embodiment according to the present invention.
Figure 11B:
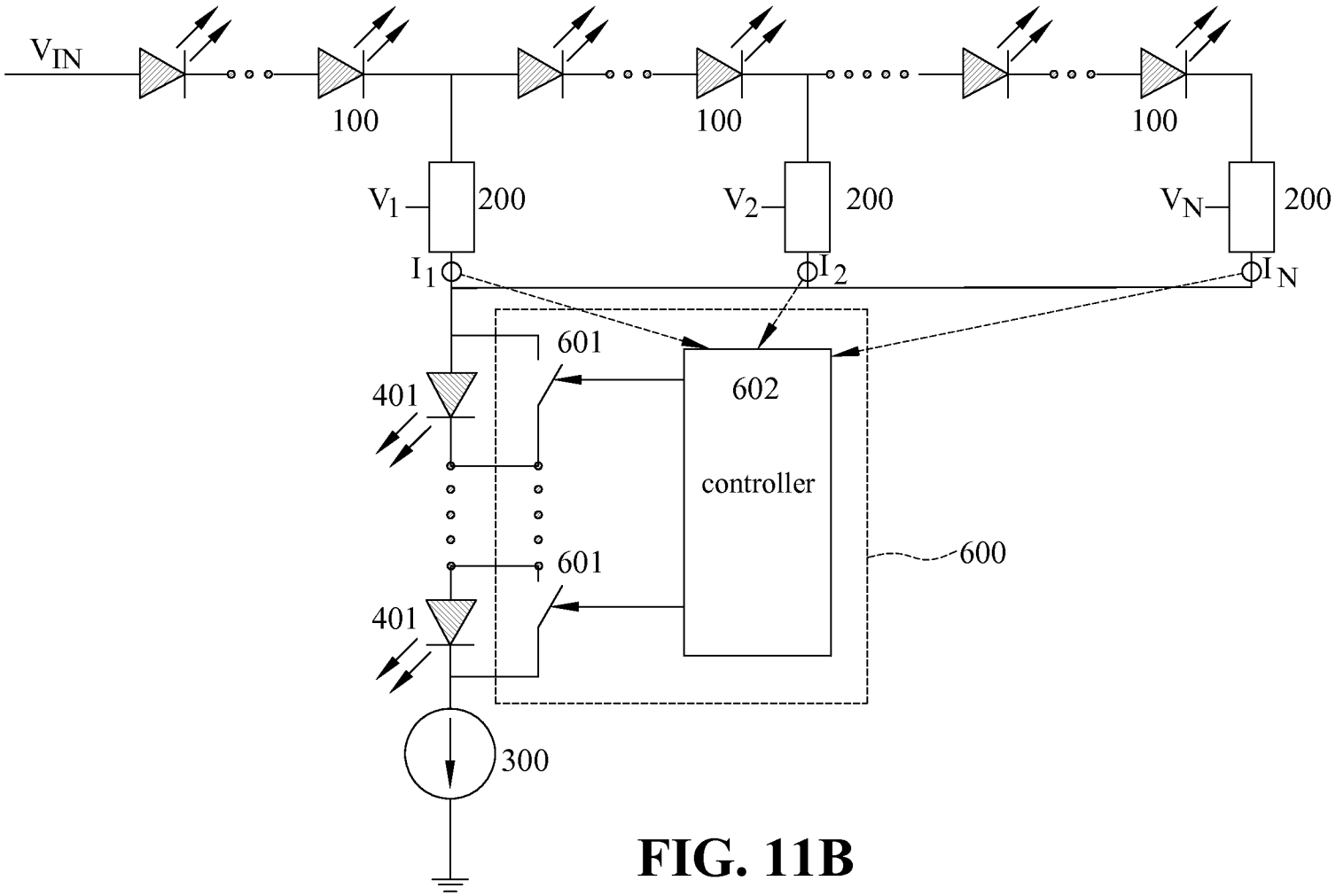
FIG. 11B shows a second example of the second implementation of the second preferred embodiment according to the present invention.

FIGS. 11A and 11B shows two examples of a second implementation of the second preferred embodiment according to the present invention. Similar to FIG. 10A, the controlling circuit 600 of the first example shown in FIG. 11A also comprises a plurality of switches 601 associated with the plurality of LED segments 401 and controlled by a controller 602. However, each switch 601 is connected in parallel with the associated LED segment 401. In this implementation, each LED segment 401 can be individually controlled and by-passed according to the voltage level at the common node.

In the second example shown in FIG. 11B, the circuit is essentially the same as the circuit of FIG. 11A. However, the plurality of switches 601 are controlled by the controller 602 to determine how the LED segments 401 are by-passed according to the respective current $I_1, I_2, \ldots$, and $I_N$ flowing through the three-terminal voltage controlled current limiting devices 200 instead of the voltage level at the common node.

Figure 12:
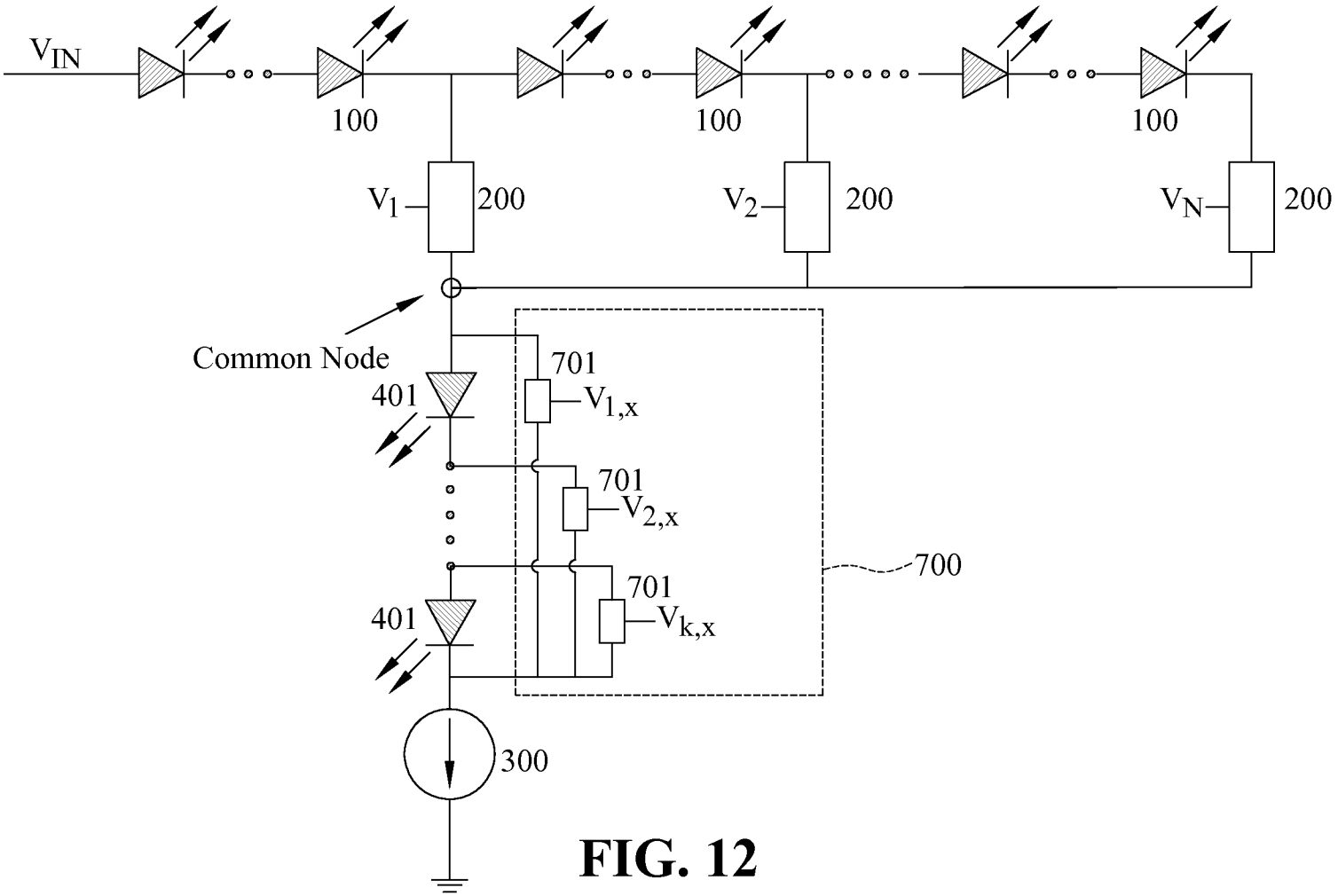
FIG. 12 shows a third implementation of the second preferred embodiment according to the present invention.

FIG. 12 shows a third implementation of the second preferred embodiment according to the present invention. As can be seen from FIG. 12, the controlling circuit 700 comprises a plurality of three-terminal voltage controlled current limiting devices 701 described before according to the present invention. Each three-terminal voltage controlled current limiting device 701 has a first terminal connected to the positive end of the associated LED segment 401, a second terminal applied with a bias voltage and a third terminal connected to the current source 300. The second terminals of the plurality of three-terminal voltage controlled current limiting devices 701 are applied with bias voltages $V_{1x}, V_{2x}, \ldots$, etc.

In the third implementation of the second preferred embodiment, the three-terminal voltage controlled current limiting devices 701 in the controlling circuit 700 can be designed with the same principle described in the previous sections. Therefore, they are not further described in detail. Overall, the circuit structure in the third implementation of the second preferred embodiment is similar to two circuits of the first preferred embodiment cascaded together.

Figure 13:
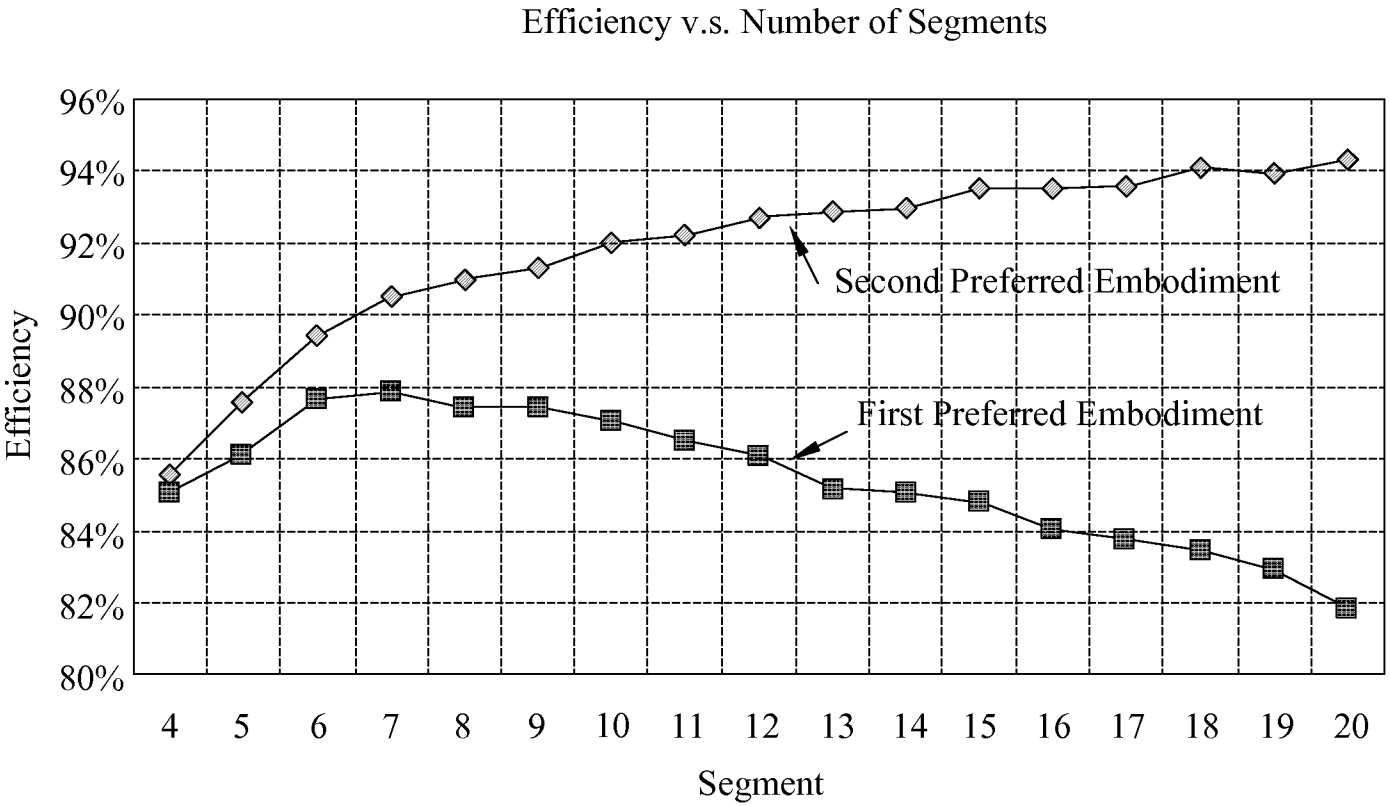
FIG. 13 shows the efficiency of the first and second preferred embodiments as a function of the total number of segments in the apparatus according to the present invention.
Figure 14:
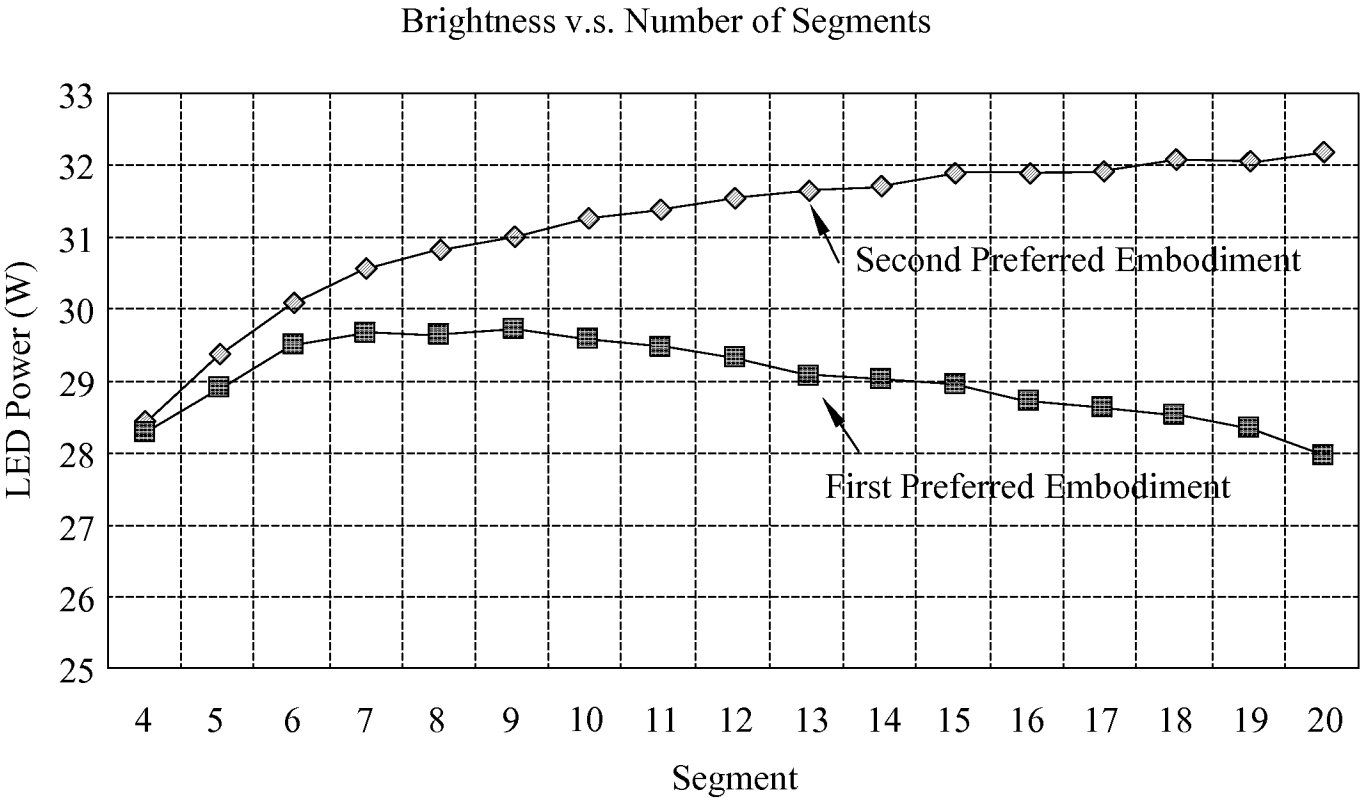
FIG. 14 shows the brightness (LED power) of the first and second preferred embodiments as a function of the total number of segments.

FIG. 13 shows the efficiency of the first and second preferred embodiments as a function of the total number of segments in the apparatus according to the present invention. The first implementation of the second preferred embodiment is shown in FIG. 13. FIG. 14 shows the corresponding brightness (LED power) as a function of the total number of segments.

Figure 15:
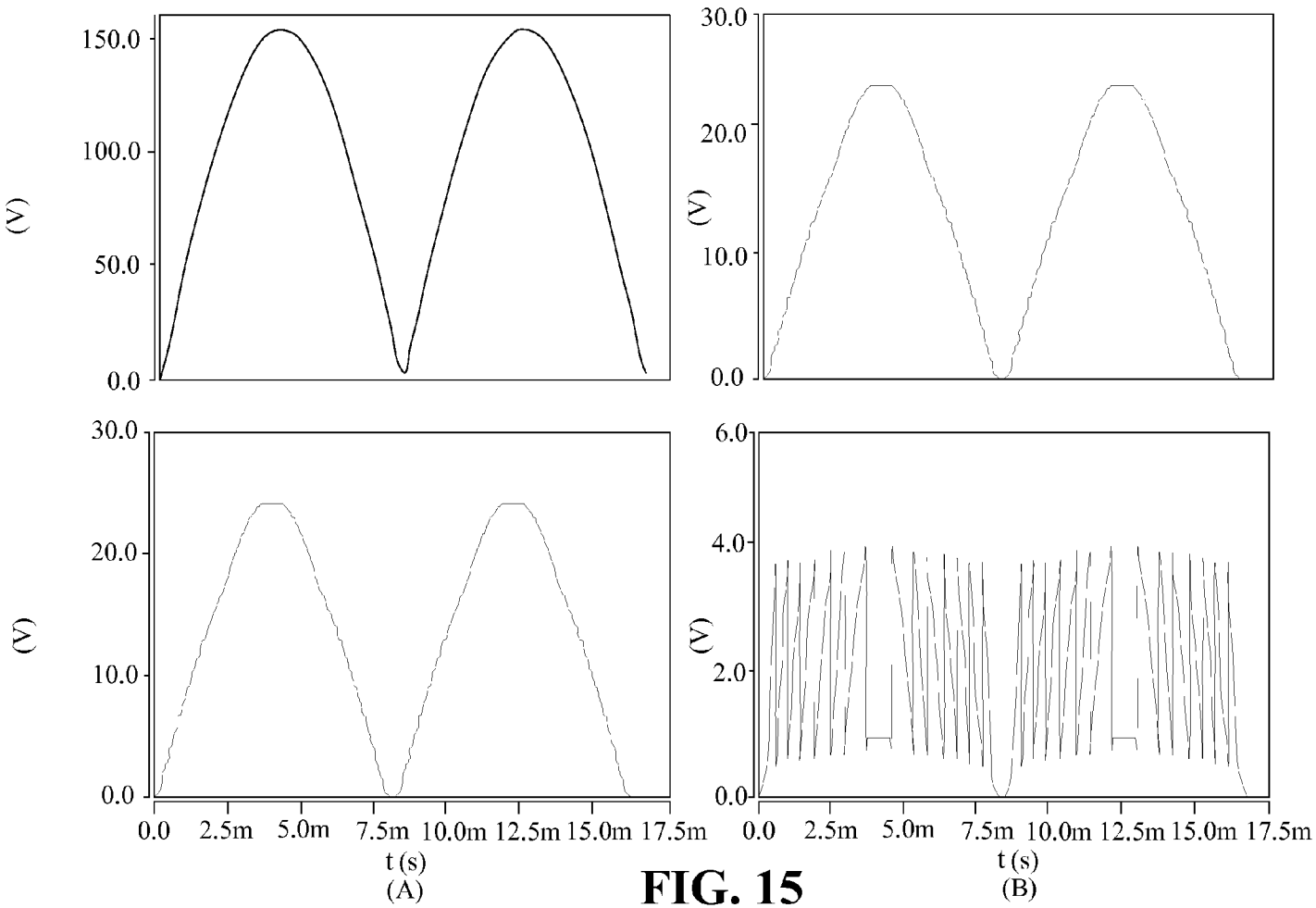
FIG. 15 shows the input voltage, and the voltage levels at the common node and the current source for the first and second preferred embodiments.

In order to illustrate the reduction of the power loss in the second preferred embodiment, the input voltage $V_{IN}$, and the voltage levels at the common node and the current source for the first and second preferred embodiments with 20 LED segments are shown in FIGS. 15A and 15B. The upper chart of FIG. 15A shows the input voltage $V_{IN}$ and the lower chart of FIG. 15A shows the voltage level at the common node. It can be seen that the voltage level at the common node increases as the input voltage $V_{IN}$ increases. In the first preferred embodiment, the common node is directly connected to the current source 300. Therefore, the voltage level at the common node is the same as the voltage level at the current source 300.

The upper and lower charts of FIG. 15B show respectively the corresponding voltage levels at the common node and the current source of the first implementation of the second preferred embodiment. As can be seen, the corresponding voltage level at the common node in FIG. 15B is the same as the voltage level at the common node of the first preferred embodiment shown in the lower chart of FIG. 15A. The corresponding voltage level at the current source 300, however, is significantly lower than the voltage level at the common node as the input voltage $V_{IN}$ varies. Therefore, the power loss from the current source 300 is significantly reduced.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for driving a plurality of LEDs, comprising:

a plurality of LEDs divided into a plurality of LED segments connected in series, each of said plurality LED segments having a positive end and a negative end;

an input voltage connected to the positive end of a leading LED segment of said plurality of LED segments;

a plurality of voltage controlled current limiting devices, each of said plurality of voltage controlled current limiting devices being associated with one of said plurality of LED segments, and having a first terminal connected to the negative end of the associated LED segment, a second terminal being applied with a bias voltage and a third terminal being connected to a common node, said bias voltage being a respective constant voltage independent of variation of said input voltage; and a current source having a first end connected to said common node and a second end connected to ground;

wherein each of said plurality of voltage controlled current limiting devices further has a threshold voltage $V_{th}$, a saturation voltage $V_{sat}$, a voltage $V_{bc}$ between said second terminal and said common node, and a voltage $V_{ac}$ between said first terminal and said common node, and each of said plurality of voltage controlled current limiting devices is cut off when the voltage $V_{bc}$ of the voltage controlled current limiting device is less than the threshold voltage $V_{th}$ of the voltage controlled current limiting device, the voltage controlled current limiting device behaves as a resistor when the voltage $V_{bc}$ is greater than the threshold voltage $V_{th}$ and the voltage $V_{ac}$ of the voltage controlled current limiting device is less than the saturation voltage $V_{sat}$ of the voltage controlled current limiting device, and the voltage controlled current limiting device conducts a constant current when the voltage $V_{bc}$ is greater than the threshold voltage $V_{th}$ and the voltage $V_{ac}$ is greater than the saturation voltage $V_{sat}$.

2. The apparatus as claimed in claim 1, wherein there are N voltage controlled current limiting devices being associated with N LED segments in order and having identical characteristics, $V_1, V_2, \ldots, V_N$ are the respective constant voltages applied to the second terminals of said N voltage controlled current limiting devices, and $V_1<V_2<\ldots<V_N$.

3. The apparatus as claimed in claim 1, wherein a trailing LED segment of said plurality of LED segments is not connected with a voltage controlled current limiting device.

4. The apparatus as claimed in claim 1, wherein the respective constant voltages applied to the second terminals of said plurality of voltage controlled current limiting devices are pre-determined so that said apparatus has two operating states including a first state in which only one of said plurality of voltage controlled current limiting devices is turned on and a second state in which only two of said plurality of voltage controlled current limiting devices are partially turned on.

5. The apparatus as claimed in claim 1, wherein there are N voltage controlled current limiting devices associated with N LED segments in order, $V_{bci}$, $V_{thi}$ and $V_i$ are the voltage $V_{bc}$, the threshold voltage $V_{th}$ and the bias voltage respectively of an i-th voltage controlled current limiting device in said N voltage controlled current limiting devices with $1 \le i \le N$, the i-th voltage controlled current limiting device conducts a maximum current when $V_{bci}=V_{thi}+\Delta V_i$, and the bias voltage $V_i$ is pre-determined so that $V_i \ge V_{i-1}+\Delta V_i+(V_{th}-V_{th(i-1)})$ for i greater than 1.

6. The apparatus as claimed in claim 1, wherein each of said plurality of voltage controlled current limiting devices further has a threshold voltage and a respective constant voltage greater than the threshold voltage applied to the second terminal so that a number of said plurality of voltage controlled current limiting devices are partially turned on at the same time.

7. An apparatus for driving a plurality of LEDs, comprising:

a plurality of LEDs divided into a plurality of LED segments connected in series, each of said plurality LED segments having a positive end and a negative end;

an input voltage connected to the positive end of a leading LED segment of said plurality of LED segments;

a plurality of voltage controlled current limiting devices, each of said plurality of voltage controlled current limiting devices being associated with one of said plurality of LED segments, and having a first terminal connected to the negative end of the associated LED segment, a second terminal being applied with a bias voltage and a third terminal being connected to a common node;

a power-loss reduction circuit having a positive end connected to said common node and a negative end; and a current source having a first end connected to the negative end of said power-loss reduction circuit and a second end connected to ground;

wherein the bias voltages applied to the second terminals of said plurality of voltage controlled current limiting devices are respective constant voltages independent of variation of said input voltage.

8. The apparatus as claimed in claim 7, wherein there are N voltage controlled current limiting devices being associated with N LED segments in order and having identical characteristics, $V_1, V_2, \ldots, V_N$ are the respective constant voltages applied to the second terminals of said N voltage controlled current limiting devices, and $V_1<V_2<\ldots<V_N$.

9. The apparatus as claimed in claim 7, wherein a trailing LED segment of said plurality of LED segments is not connected with a voltage controlled current limiting device.

10. The apparatus as claimed in claim 7, wherein the respective constant voltages applied to the second terminals of said plurality of voltage controlled current limiting devices are pre-determined so that said apparatus has two operating states including a first state in which only one of said plurality of voltage controlled current limiting devices is turned on and a second state in which only two of said plurality of voltage controlled current limiting devices are partially turned on.

11. The apparatus as claimed in claim 7, wherein each of said plurality of voltage controlled current limiting devices further has a threshold voltage $V_{th}$, a saturation voltage $V_{sat}$, a voltage $V_{bc}$ between said second terminal and said common node, and a voltage $V_{ac}$ between said first terminal and said common node, and each of said plurality of voltage controlled current limiting devices is cut off when the voltage $V_{bc}$ of the voltage controlled current limiting device is less than the threshold voltage $V_{th}$ of the voltage controlled current limiting device, the voltage controlled current limiting device behaves as a resistor when the voltage $V_{bc}$ is greater than the threshold voltage $V_{th}$ and the voltage $V_{ac}$ of the voltage controlled current limiting device is less than the saturation voltage $V_{sat}$ of the voltage controlled current limiting device, and the voltage controlled current limiting device conducts a constant current when the voltage $V_{bc}$ is greater than the threshold voltage $V_{th}$ and the voltage $V_{ac}$ is greater than the saturation voltage $V_{sat}$.

12. The apparatus as claimed in claim 11, wherein there are N voltage controlled current limiting devices associated with N LED segments in order, $V_{bci}$, $V_{thi}$ and $V_i$ are the voltage $V_{bc}$, the threshold voltage $V_{th}$ and the bias voltage respectively of an i-th voltage controlled current limiting device in said N voltage controlled current limiting devices with $1 \le i \le N$, the i-th voltage controlled current limiting device conducts a maximum current when $V_{bci}=V_{thi}+\Delta V_i$, and the bias voltage $V_i$ is pre-determined so that $V_i \ge V_{i-1}+\Delta V_i+(V_{th}-V_{th(i-1)})$ for i greater than 1.

13. The apparatus as claimed in claim 7, wherein said power-loss reduction circuit comprises a plurality of LEDs divided into a plurality of LED segments controlled by a LED controlling circuit.

14. The apparatus as claimed in claim 13, wherein said LED controlling circuit comprises a controller and a plurality of switches controlled by the controller, each of said plurality of switches being associated with one of said plurality of LED segments in said power-loss reduction circuit.

15. The apparatus as claimed in claim 14, wherein the controller controls said plurality of switches according to a voltage level at said common node.

16. The apparatus as claimed in claim 14, wherein the controller controls said plurality of switches according to currents flowing through said plurality of voltage controlled current limiting devices.

17. The apparatus as claimed in claim 14, wherein each of said plurality of switches is connected in parallel with the associated LED segment in said power-loss reduction circuit.

18. The apparatus as claimed in claim 14, wherein each of said plurality of switches has a first end connected to a positive end of the associated LED segment in said power-loss reduction circuit and a second end connected to the negative end of said power-loss reduction circuit.

19. The apparatus as claimed in claim 13, wherein said LED controlling circuit comprises a plurality of voltage controlled current limiting devices, each of said plurality of voltage controlled current limiting devices in said LED controlling circuit is associated with one of said plurality of LED segments in said power-loss reduction circuit, and has a first terminal connected to a positive end of the associated LED segment, a second terminal being applied with a bias voltage and a third terminal being connected to the negative end of said power-loss reduction circuit, and the bias voltages applied to the second terminals of said plurality of voltage controlled current limiting devices in said LED controlling circuit are respective constant voltages independent of variation of said input voltage.

20. The apparatus as claimed in claim 19, wherein there are K voltage controlled current limiting devices being associated with K LED segments in order in said power-loss reduction circuit and having identical characteristics, $V_{1x}$, $V_{2x}, \ldots, V_{Kx}$ are the respective constant voltages applied to the second terminals of said K voltage controlled current limiting devices, and $V_{1x}<V_{2x}<\ldots<V_{Kx}$.

21. The apparatus as claimed in claim 19, wherein the respective constant voltages applied to the second terminals of said plurality of voltage controlled current limiting devices in said LED controlling circuit are pre-determined so that said power-loss reduction circuit has two operating states including a first state in which only one of said plurality of voltage controlled current limiting devices in said LED controlling circuit is turned on and a second state in which only two of said plurality of voltage controlled current limiting devices in said LED controlling circuit are partially turned on.

22. The apparatus as claimed in claim 19, wherein each of said plurality of voltage controlled current limiting devices in said LED controlling circuit further has a threshold voltage $V_{thx}$, a saturation voltage $V_{satx}$, a voltage $V_{bcx}$ between the second terminal and the negative end of said power-loss reduction circuit, and a voltage $V_{acx}$ between the first terminal and the negative end of said power-loss reduction circuit, and each of said plurality of voltage controlled current limiting devices in said LED controlling circuit is cut off when the voltage $V_{bcx}$ of the voltage controlled current limiting device is less than the threshold voltage $V_{thx}$ of the voltage controlled current limiting device, the voltage controlled current limiting device behaves as a resistor when the voltage $V_{bcx}$ is greater than the threshold voltage $V_{thx}$ and the voltage $V_{acx}$ of the voltage controlled current limiting device is less than the saturation voltage $V_{satx}$ of the voltage controlled current limiting device, and the voltage controlled current limiting device conducts a constant current when the voltage $V_{bcx}$ is greater than the threshold voltage $V_{thx}$ and the voltage $V_{acx}$ is greater than the saturation voltage $V_{satx}$.

23. The apparatus as claimed in claim 22, wherein there are K voltage controlled current limiting devices associated with K LED segments in order in said power-loss reduction circuit, $V_{bcxj}$, $V_{thxj}$ and $V_{jx}$ are the voltage $V_{bcx}$, the threshold voltage $V_{thx}$ and the bias voltage respectively of an j-th voltage controlled current limiting device in said K voltage controlled current limiting devices with $1 \le j \le K$, the j-th voltage controlled current limiting device conducts a maximum current when $V_{bcxj}=V_{thxj}+\Delta V_j$, and the bias voltage $V_{jx}$ is pre-determined so that $V_{jx} \ge V_{(j-1)x}+\Delta V_{jx}+(V_{thxj}-V_{thx(j-1)})$ for j greater than 1.

* * * * *